US005158646A

United States Patent [19]

Nakajima

[11] Patent Number: 5,158,646

[45] Date of Patent: * Oct. 27, 1992

[54] PROCESS FOR MODIFYING HYDROPHILIC FIBERS WITH SUBSTANTIALLY WATER-INSOLUBLE INORGANIC SUBSTANCE

[75] Inventor: Keihachiro Nakajima, Tokyo, Japan

[73] Assignee: Oji Paper Co., Ltd, Tokyo, Japan

[ * ] Notice: The portion of the term of this patent subsequent to Jun. 16, 2009 has been disclaimed.

[21] Appl. No.: 778,555

[22] Filed: Oct. 18, 1991

Related U.S. Application Data

[63] Continuation-in-part of Ser. No. 699,071, May 13, 1991, Pat. No. 5,122,230.

[30] Foreign Application Priority Data

May 14, 1990 [JP] Japan ..... 2-121221
Jun. 22, 1990 [JP] Japan ..... 2-162946

[51] Int. Cl.[5] ..... D21H 17/70

[52] U.S. Cl. ..... 162/9; 162/157.1; 162/157.2; 162/157.3; 162/157.4; 162/181.2; 162/181.3

[58] Field of Search ..... 162/9, 182, 183, 181.1-181.7, 162/157.2, 157.1, 157.3, 157.4

[56] References Cited

U.S. PATENT DOCUMENTS

| | | | |
|---|---|---|---|
| 113,454 | 4/1871 | Schmidt | 162/181.2 |
| 670,511 | 3/1901 | Friese-Greene | 162/181.2 |
| 2,399,982 | 5/1946 | Britt | 162/181.7 |
| 2,583,548 | 1/1952 | Craig | 161/181.2 |
| 2,599,091 | 6/1952 | Craig | 162/181.2 |
| 2,599,093 | 6/1952 | Craig | 162/181.2 |
| 2,599,094 | 6/1952 | Craig | 162/181.2 |
| 2,709,653 | 5/1955 | Marshall et al. | 162/181.2 |
| 2,823,997 | 2/1958 | Craig | 162/181.2 |
| 3,029,181 | 4/1962 | Thomsen | 162/181.1 |
| 3,044,924 | 7/1962 | Schur | 162/181.5 |

FOREIGN PATENT DOCUMENTS

| | | | |
|---|---|---|---|
| 62-162098 | 7/1987 | Japan | 162/181.2 |
| 62-199898 | 9/1987 | Japan | 162/181.2 |
| 726803 | 3/1955 | United Kingdom | 162/181.2 |

*Primary Examiner*—Peter Chin
*Attorney, Agent, or Firm*—Armstrong & Kubovcik

[57] ABSTRACT

A hydrophilic fibers modified with a substantially water-insoluble inorganic compound is produced by immersing hydrophilic fibers, for example, pulp fibers, in an aqueous solution of a water-soluble inorganic compound (a) selected from aluminates, silicates and zincates of alkali metals with a precipitant (b) containing an aqueous solution of hydrochloric acid or sulfuric acid, adjusting the amount of the aqueous solution impregnated in the hydrophilic fibers to 60 to 400% based on the weight of the hydrophilic fibers, and bringing the hydrophilic fibers with the aqueous solution of the inorganic compound (a) into contact with the precipitant (b), to thereby cause the resultant substantially water-insoluble compound to be precipitated in and fixed to the hydrophilic fibers.

3 Claims, No Drawings

PROCESS FOR MODIFYING HYDROPHILIC FIBERS WITH SUBSTANTIALLY WATER-INSOLUBLE INORGANIC SUBSTANCE

RELATIONSHIP TO OTHER APPLICATIONS

This application is a continuation in part of our copending application Ser. No. 07/699,071, filed May 13, 1991 now U.S. Pat. No. 5,122,230.

BACKGROUND OF THE INVENTION

1) Field of the Invention

The present invention relates to a process for producing hydrophilic fibers with a water-insoluble inorganic substance. More particularly, the present invention relates to a process for producing hydrophilic fibers modified with a substantially water-insoluble inorganic substance, for example, a substantially water-insoluble metal hydroxide, precipitated in and fixed to bores, pores and surfaces of the hydrophilic fibers, to provide modified hydrophilic fibers useful as a paper-forming material, a shaped article-forming material, and other functional materials in which the specific functions of the substantially water-insoluble inorganic substance carried by the hydrophilic fibers are utilized.

2) Description of the Related Art

Various processes for producing hydrophilic fibers, for example, paper-forming pulp fibers, modified with a substantially water-insoluble hydroxide, for example, aluminum hydroxide, are known from Japanese Examined Patent Publication No. 56-18,712, which discloses a process wherein fine particles of aluminum hydroxide are adhered to surfaces of a paper sheet by a coating method; from Japanese Unexamined Patent Publication No. 57-144,754, which discloses a process wherein a paper sheet containing 70% by weight or more of aluminum hydroxide is formed from a pulp slurry containing an aluminum hydroxide powder; and from Japanese Unexamined Patent Publication No. 57-171,799, which discloses a process wherein a paper sheet containing 50 to 95% by weight of aluminum hydroxide is produced from a pulp slurry containing an aluminum hydroxide powder together with a sizing agent and binder.

In these conventional processes, the substantially water-insoluble inorganic substance are adhered in the form of fine particles to a surface of a paper sheet, or mixed in the form of fine particles to provide a pulp slurry, but a water-soluble inorganic compound is not utilized to provide the substantially water-insoluble inorganic substance.

As conventional methods wherein a water-soluble inorganic substance, for example sodium aluminate, is utilized for paper-making, Chizhov, G. I. et al., Mezhvuz, Sb. Mauch. Tr., Khimiya Tekhnol. Tsellyulozy, No. 8, 67–70 (1981) discloses a use of sodium aluminate mixed to a pulp, to enhance a mechanical strength of the resultant paper sheet; U.S. Pat. No. 3,706,629 discloses an addition of a polymeric electrolyte and an aluminate of an alkali metal to a pulp, to improve the dehydration property and retention of the pulp in the paper-forming step; and Canadian Patent No. 964,808 teaches an addition of a water-soluble aluminum salt and sodium aluminate to a pulp.

Nevertheless, these conventional methods do not teach a conversion of a water-soluble inorganic compound to a substantially water-insoluble inorganic substance on or within a hydrophilic fiber.

Lagally, P. and Lagally, H., Tappi, 42 (11), 888 (1959) teach a method of precipitating a gel-like aluminum hydroxide on pulp fibers by immersing the pulp fibers in an aqueous solution of sodium aluminate and neutralizing the sodium aluminate aqueous solution with a mineral acid, but this method is disadvantageous in that, since the mineral acid is added to the pulp slurry containing sodium aluminate, a major portion of the resultant gel-like aluminum hydroxide remains in the pulp slurry but not in and on the pulp fibers, and thus the utilization efficiency of the resultant aluminum hydroxide for the pulp fibers is poor.

This method is intended to increase the mechanical strength of the resultant paper sheet by the combination of the gel-like aluminum hydroxide with the cellulose pulp fibers, but the amount of the gel-like aluminum hydroxide picked up by the pulp fibers is relatively small, and thus the increase in the mechanical strength of the resultant paper sheet is unsatisfactory.

A method similar to that mentioned above is disclosed by Hechler E., Wochenblatt für Papierfabrikation, 96 (23/24), 868 (1968). In this method, a beaten pulp slurry is supplemented with sodium aluminate in an amount of 5% based on the weight of the pulp, and then brought into contact with carbon dioxide, aluminum sulfate or calcium carbonate, to convert the sodium aluminate in the pulp slurry to aluminum hydroxide and thereby provide a filler-containing pulp usable for paper-formation.

This method, however, is disadvantageous in that the effective utilization efficiency of the resultant aluminum hydroxide is unsatisfactory.

Further, J. G., Soluble Silicates, ACS Monograph Series, Reinhold, N.Y., Vol. 2, 333 (1952) discloses a method in which sodium silicate (soluble glass) is added to a pulp slurry and the pH of the resultant sodium silicate-containing pulp slurry is lowered, to cause the resultant silicic acid gel to be precipitated. The purpose of this method is to size the resultant paper sheet with the silicic acid gel, and therefore, the amount of the silicic acid gel picked up by the pulp fibers must be relatively small.

Cray, W. L., Pulp and Paper Magazine of Canada, August, 116 (1955) discloses a process in which a pulp slurry is supplemented with calcium chloride and then with sodium silicate to produce calcium silicate in the pulp slurry, and thereafter, aluminum sulfate is added to the pulp slurry to cause the resultant calcium sulfate to be precipitated in the pulp fibers in the slurry.

This process, however, is not suitable for causing a large amount of a water-insoluble inorganic substance to be carried on the pulp fibers.

Japanese Unexamined Patent Publication No. 62-144,901 discloses a process in which two different types of water-soluble inorganic compound aqueous solutions, which form a water-insoluble and flame-resistant inorganic compound when mixed together, for example, an aqueous solution of barium chloride and boric acid and an aqueous solution of hydrogen ammonium phosphate and boric acid, is proposed; a wood material is immersed in one of the above-mentioned aqueous solutions and then in the other aqueous solution, to cause the resultant water-insoluble and flame resistant inorganic compound to be dispersed and carried in the wood material. This method is effectively produces a flame-resistant wood material, but is not suitable for modifying a hydrophilic fibrous material usable for paper.

Accordingly, it is not as yet known how to impart and fix a large amount of a substantially water-insoluble inorganic substance to hydrophilic fibers, for example, paper-forming pulp fibers.

SUMMARY OF THE INVENTION

An object of the present invention is to provide a process for modifying hydrophilic fibers with a substantially water-insoluble inorganic substance, in a large amount and at a high efficiency.

Another object of the present invention is to provide a process for modifying hydrophilic fibers with a substantially water-insoluble inorganic substance in a large amount, to thereby provide modified hydrophilic fibers having an enhanced flame resistance, dimensional stability, heat resistance, opacity, and/or hydroscopicity and useful for paper sheets, shaped articles and functional materials.

The above-mentioned objects can be attained by the process of the present invention for modifying hydrophilic fibers with a substantially water-insoluble inorganic substance, comprising the steps of:

immersing hydrophilic fibers in an aqueous solution of a water-soluble inorganic compound (a) selected from the group consisting of aluminates, silicates and zincates of alkali metals, in a concentration of 11 to 50% by weight;

adjusting the amount of the water-soluble inorganic compound (a) aqueous solution impregnated in the hydrophilic fibers to a level of 60 to 400% based on the dry weight of the hydrophilic fibers; and bringing the impregnated hydrophilic fibers into contact with the precipitant (b) comprising an aqueous solution containing a mineral acid selected from the group consisting of hydrochloric acid and sulfuric acid to cause the resultant substantially water-insoluble compound to be precipitated in and fixed, in an amount of 11 to 150% based on the dry weight of the hydrophilic fibers, to the hydrophilic fibers.

DESCRIPTION OF THE PREFERRED EMBODIMENTS

The hydrophilic fibers usable for the process of the present invention are not limited to a specific type of fibers, and can be selected from among known hydrophilic synthetic fibers; for example, polyvinylalcohol fibers and polyacrylamide fibers, and from hydrophilic natural fibers; for example, lignocellulosic fibers.

The hydrophilic fibers are preferably lignocellulosic fibers, especially lignocellulosic pulp fibers for paper.

The lignocellulosic fibers may be those derived from wood materials or herbaceous plants.

The pulp fibers usable for the process of the present invention may be those produced by any type of pulping methods and treated by any type of procedures, for example, bleaching, beating, and dyeing, and by a chemical treatment.

In the first step of the process of the present invention, the hydrophilic fibers are immersed in an aqueous solution of a water-insoluble inorganic compound (a) selected from the group consisting of aluminates, silicates and zincates of alkali metals.

In the immersing step, the water-soluble inorganic compound (a) is present in a relatively high concentration of 11 to 50% by weight, more preferably 20 to 40% by weight, in the aqueous solution thereof, to cause a large amount of the inorganic compound (a) to be impregnated in the hydrophilic fibers.

Some of the high concentration aqueous solution of the inorganic compound (a), for example, alkali aluminate, can swell the cellulosic fibers, but this effect is unsatisfactory when the concentration of the inorganic compound (a) is less than 11% by weight.

The concentration of the inorganic compound (a) in the aqueous solution influences the amount of the substantially water-insoluble inorganic compound impregnated in the hydrophilic fibers. Namely, the higher the concentration of the inorganic compound (a), the larger the amount of the resultant substantially water-insoluble inorganic compound fixed to the hydrophilic fibers.

The immersing step can be carried out at any temperature between the freezing point and the boiling point of the aqueous solution of the inorganic compound (a).

Also, there is no restriction of the time for which the hydrophilic fibers are immersed in the aqueous solution of the inorganic compound (a).

In the second step of the process of the present invention, the amount of the aqueous solution of the inorganic compound (a) impregnated in the hydrophilic fibers is adjusted to a level of 60 to 400% based on the dry weight of the hydrophilic fibers.

In the adjusted hydrophilic organic fibers impregnated with the aqueous solution of the water-soluble inorganic compound (a), the dry content of the fibers is preferably 30% by weight or more.

The amount of the inorganic compound (a) aqueous solution picked up by the hydrophilic fibers governs the amount of the resultant substantially water-insoluble inorganic compound fixed to the hydrophilic fibers. Namely, the larger the amount of the inorganic compound (a) aqueous solution picked up by the hydrophilic fibers, the larger the amount of the resultant substantially water-insoluble inorganic compound fixed to the hydrophilic fibers.

The adjustment of the amount of the inorganic compound (a) aqueous solution picked up by the hydrophilic fibers can be effected by any one of the conventional procedures; for example, squeezing, gravitative dehydration on a net, suction dehydration, centrifugalizing, and pressing.

By removing an excessive amount of the inorganic compound (a) aqueous solution from the immersed hydrophilic fibers, almost all of the aqueous solution located on the surfaces of the hydrophilic fibers can be removed, so that almost all of the picked up aqueous solution is located inside of the hydrophilic fibers (for paper-forming wood pulp fibers, on the cell walls in the fibers) and in the resultant modified hydrophilic fibers, the resultant substantially water-insoluble inorganic compound is located mainly inside of the fibers. When the amount of the inorganic compound (a) aqueous solution picked up by the hydrophilic fibers is less than 60%, the amount of the resultant substantially water-insoluble inorganic compound fixed to the hydrophilic fibers becomes too low, and the property of the resultant modified fibers becomes unsatisfactory.

Also, if the amount of the inorganic compound (a) aqueous solution is more than 400%, a large amount of the substantially water-insoluble inorganic compound is formed on the surfaces of the hydrophilic fibers. The substantially water-insoluble inorganic compound on the fiber surfaces is easily removed, and therefore, the efficiency of modifying the imported substantially water-insoluble inorganic compound for the hydrophilic fibers becomes poor.

In the third step of the process of the present invention, the impregnated hydrophilic fibers are brought into contact with the precipitant (b), to thereby cause the resultant substantially water-insoluble inorganic compound to be precipitated in and fixed to the hydrophilic fibers.

In the process of the present invention, the water-soluble inorganic compound (a) is selected from aluminates, silicates and zincates of alkali metals, and the precipitant (b) comprises an aqueous solution containing at least one acid compound preferably selected from hydrochloric acid and sulfuric acid.

The precipitant (b) is prepared by dissolving the acid compound in water.

In the third step of the process of the present invention, the contact of the hydrophilic fibers impregnated with the water-soluble inorganic compound (a) aqueous solution with the precipitant aqueous solution (b) is carried out by immersing the impregnated hydrophilic fibers in the precipitant aqueous solution (b), or spraying the precipitant aqueous solution (b) onto the impregnated hydrophilic fibers.

There is no restriction of the concentration of the acid compound in the precipitant aqueous solution, as long as substantially the entire amount of the water-soluble inorganic compound present on and in the hydrophilic fibers can be converted to the corresponding substantially water-insoluble compound during the contact of the impregnated hydrophilic fibers with the precipitant aqueous solution. Nevertheless, preferably the acid compound is present in an amount of 5 to 500 g/l in the precipitant aqueous solution (b).

The contact time of the impregnated hydrophilic fibers with the precipitant aqueous solution should be long enough to completely convert the entire amount of the water-soluble compound (a) present on and in the impregnated hydrophilic fibers to the corresponding substantially water-insoluble compound, and usually this contact time is from 5 minutes to 5 hours.

There is no restriction of the temperature of the precipitant aqueous solution, as long as the temperature is in the range of from the freezing point and the boiling point of the aqueous solution. Also, there is no limitation on the time of contact of the impregnated hydrophilic fibers with the precipitant aqueous solution.

In the third step of the process of the present invention, the amount of the substantially water-insoluble compound fixed to the hydrophilic fibers must be controlled to a level of from 11% to 150% based on the dry weight of the hydrophilic fibers.

If the amount of the fixed substantially water-insoluble compound is less than 11%, the resultant modified fibers exhibit unsatisfactory functional properties, for example, flame resistance, dimensional stability, heat resistance, opacity and/or hydroscopicity. If the substantially water-insoluble compound is fixed in an amount of more than 150%, a portion of the fixed compound is located on the outer surfaces of the modified fibers, and thus is easily removed during the processing, handling, or use of the modified fibers.

When the amount of the fixed substantially water-insoluble compound is in the range of from 11% to 150% based on the dry weight of the hydrophilic fibers, almost all of the fixed substantially water-insoluble compound is located within the hydrophilic fibers, and therefore, is stably held by the fibers.

The process of the present invention is useful for easily producing hydrophilic fibers carrying therein a large amount of water-insoluble inorganic compound, at a low cost and high efficiency.

By utilizing the process of the present invention, a large amount of the water-insoluble inorganic compound can be precipitated not only on the surface but also inside of the hydrophilic fibers, and the resultant modified hydrophilic fibers exhibit a specific function, for example, an enhanced flame resistance, derived from the water-insoluble inorganic compound fixed to the fibers.

EXAMPLES

The present invention will be further illustrated by the following specific examples.

EXAMPLE 1

A beaten, bleached soft wood kraft pulp having a Canadian Standard freeness (CSF) of 350 ml and in an bone dry amount of 100 g was immersed in 5,000 g of an aqueous solution of sodium silicate (molar ratio $SiO_2/NaO_2=3.10$, concentration=42.0 Bé=38% by weight) at room temperature for 3 hours, removed from the sodium silicate solution, and then centrifugated at a gravity acceleration of 900 g for 3 minutes. The resultant impregnated pulp had a weight of 490 g, and the amount of the sodium silicate solution impregnated in the pulp fibers was 390% based on the bone dry weight of the pulp.

The impregnated pulp with the sodium silicate solution was immersed in 3,250 ml of a 1.2N sulfuric acid aqueous solution at a temperature of 2° C. for one hour. Then, the modified pulp was removed from the sulfuric acid solution and centrifugated, washed with water until the water drainage became neutral, and then dried.

The resultant modified pulp had the same appearance as non-modified pulp and was composed of individual pulp fibers which were separated from each other.

The modified pulp was then incinerated at a temperature of 900° C., to determine the amount of silicon dioxide carried in and fixed to the pulp fibers, and as a result, it was confirmed that the amount of the fixed silicon dioxide was 82%, based on the dry weight of the pulp fibers.

EXAMPLE 2 AND COMPARATIVE EXAMPLE 1

In Example 2, the same procedures as in Example 1 were carried out, with the following exceptions.

The sodium silicate aqueous solution was replaced by an aqueous solution of sodium aluminate ($Al_2O_3$ content=20%, $Na_2O$ content=19%).

The impregnated and centrifugated pulp was pressed between blotter sheets under a pressure of 3.5 kg/cm$^2$ for 2 minutes. The pressed pulp had a weight of 320 g. The amount of the sodium aluminate solution impregnated in the pulp fibers was 220% based on the bone dry weight of the pulp fibers.

The 1.2N sulfuric acid aqueous solution was replaced by 3,250 ml of a 0.5N sulfuric acid aqueous solution, and the immersion operation of the impregnated pulp fibers with the sodium aluminate solution therein was carried out at room temperature for one hour.

The resultant modified pulp had the same appearance as non-modified pulp and was composed of individual pulp fibers which were separated from each other.

The modified pulp was incinerated at a temperature of 900° C., to determine the amount of aluminum hydroxide carried in and fixed to the pulp fibers, and as a result, it was confirmed that the amount of fixed aluminum hydroxide was 45%, based on the dry weight of the pulp fibers.

Also, the pulp fibers were observed by a microscope, and as a result, it was confirmed that almost all of the aluminum hydroxide imparted to the pulp fibers was located inside of the pulp fibers, and that substantially no aluminum hydroxide was located on the surface and in the lumen of the pulp fibers.

The modified pulp (A) was converted to a paper sheet having a basis weight of 100 g/m$^2$, by a customary paper forming process.

In Comparative Example 1, a paper sheet (B) with a basis weight of 100 g/m$^2$ was produced from an aqueous slurry of a mixture of the same non-modified pulp as used in Example 2, with aluminum hydroxide dispersed therein.

The amount of the aluminum hydroxide contained in the paper sheet (B) is the same as that contained in the paper sheet (A).

The flame resistances of the paper sheets (A) and (B) were measured in accordance with JIS A 1322. The results are shown in Table 1.

TABLE 1

| | Item | | | | |
|---|---|---|---|---|---|
| | | | Burning test | | |
| Example No. | Type of paper sheet | Amount of $Al(OH)_3$ (%) | Carbonization length (cm) | After-flaming (sec) | After-glow (sec) |
| Example 2 | (A) | 45 | 5 | 0 | 5 |
| Comparative Example 1 | (B) | 45 | Immediately ignited and burnt | | |

Table 1 clearly shows that the modified pulp paper sheet of Example 2 exhibited a satisfactory flame resistance, whereas the non-modified pulp paper sheet of Comparative Example 1, in which aluminum hydroxide in the same amount as in Example 2 was mixed with the non-modified pulp fibers, exhibited substantially no flame resistance.

I claim:

1. A process for modifying hydrophilic fibers with a substantially water-insoluble inorganic substance, comprising the steps of:

immersing hydrophilic fibers in an aqueous solution of a water-soluble inorganic compound (a) selected from the group consisting of aluminates, silicates and zincates of alkali metals, in a concentration of 11 to 50% by weight;

adjusting the amount of the water-soluble inorganic compound (a) aqueous solution impregnated in the hydrophilic fibers to a level of 60 to 400% based on the dry weight of the hydrophilic fibers; and bringing the impregnated hydrophilic fibers into contact with the precipitant (b) comprising an aqueous solution containing at least one acid compound selected from the group consisting of hydrochloric acid and sulfuric acid to cause the resultant substantially water-insoluble compound to be precipitated in and fixed, in an amount of 11 to 150% based on the dry weight of the hydrophilic fibers, to the hydrophilic fibers.

2. The process as claimed in claim 1, wherein the hydrophilic fibers are selected from polyvinylalcohol fibers, polyacrylamide fibers and lignocellulosic fibers.

3. The process as claimed in claim 2, wherein the cellulosic fibers are pulp fibers.

* * * * *